US006588499B1

(12) United States Patent
Fahlsing

(10) Patent No.: US 6,588,499 B1
(45) Date of Patent: Jul. 8, 2003

(54) AIR EJECTOR VACUUM CONTROL VALVE

(75) Inventor: Paul M. Fahlsing, Wilsonville, OR (US)

(73) Assignee: Pacificorp, Portland, OR (US)

( * ) Notice: Subject to any disclaimer, the term of this patent is extended or adjusted under 35 U.S.C. 154(b) by 0 days.

(21) Appl. No.: 09/191,737

(22) Filed: Nov. 13, 1998

(51) Int. Cl.[7] ..... F28B 11/00

(52) U.S. Cl. ..... 165/231; 165/281; 165/286; 165/111; 165/112; 165/113; 165/278; 60/661; 60/686; 60/693

(58) Field of Search ..... 60/695, 685, 686, 60/661, 692, 693; 165/278, 111, 113, 231, 281, 286, 112

(56) References Cited

U.S. PATENT DOCUMENTS

| | | | | |
|---|---|---|---|---|
| 308,756 A | | 12/1884 | Dingley | |
| 1,456,871 A | * | 5/1923 | Ehrhart | 165/302 |
| 1,584,758 A | * | 5/1926 | Ehrhart | 60/686 |
| 1,719,138 A | | 7/1929 | Roucka | |
| 2,247,056 A | * | 6/1941 | Howard | 165/278 |
| 2,261,584 A | | 11/1941 | Knowlton et al. | 257/2 |
| 3,094,165 A | * | 6/1963 | Droescher | 165/111 |
| 3,660,980 A | * | 5/1972 | Khrisch et al. | 60/686 |
| 3,825,062 A | * | 7/1974 | Heller et al. | 165/111 |
| 4,045,961 A | * | 9/1977 | Schoonman | 60/686 |
| 4,129,180 A | * | 12/1978 | Larinoff | 165/111 |
| 4,165,616 A | | 8/1979 | Pierpoline | 60/686 |
| 4,190,102 A | | 2/1980 | Gerz | 165/113 |
| 4,272,962 A | | 6/1981 | Viscovich et al. | 60/648 |
| 4,518,035 A | * | 5/1985 | Larinoff | 165/111 |
| 4,620,588 A | | 11/1986 | Pfouts et al. | 165/32 |
| 4,642,992 A | | 2/1987 | Julovich | 60/661 |

FOREIGN PATENT DOCUMENTS

| | | | | |
|---|---|---|---|---|
| JP | 55-60174 | * | 5/1980 | |
| JP | 56-142383 | * | 11/1981 | |
| JP | 59-4884 | * | 1/1984 | |
| JP | 59-52193 | * | 3/1984 | |
| JP | 1-98895 | * | 4/1989 | 60/686 |
| JP | 3-54304 | * | 3/1991 | |
| JP | 4-76388 | * | 3/1992 | |
| JP | 11-83344 | * | 3/1999 | |
| SU | 0756171 | * | 8/1980 | 60/686 |

OTHER PUBLICATIONS

Fahlsing, Paul M., "VFD retrofit provides 3.75–MW boosts to air–cooled Wyodak Power Plant," *Power Engineering* vol. 100, No.05, May 1996.

"Operations and Maintenance Instructions Lummusaire Air-cooled Steam Condenser" (no date).

"Operating Experience and Performance Testing of the World's Largest Air–Colled Condenser" (no date).

Larinoff, Michael W., "Can you air–cooled condenser handle the big chill," *Fossil–Fired Steam/Electric*, Jan./Feb. 1997.

Fahlsing, Paul M., P.E., "Benefits of Variable Speed Drives Applied on Dry Consensing at the Wyodak Plant," *Joint Power Generation Conference*, PWR–vol. 28, 1995 vol. 3 ASME 1995.

*Primary Examiner*—John K. Ford
(74) *Attorney, Agent, or Firm*—Todd E. Zenger; Kirton & McConkie

(57) ABSTRACT

The present invention comprises a method and device for deterring the freezing within a condenser by preventing critical pressure differentials from building up between the exhaust steam header and the air ejector systemy. The means for regulating pressure in the air ejector system prevents the pressure difference between the turbine exhaust and the air ejector system from being great enough to carry condensate through a condensing tube into an air ejector system.

(List continued on next page.)

10 Claims, 7 Drawing Sheets

U.S. PATENT DOCUMENTS

| | | | | | |
|---|---|---|---|---|---|
| 4,765,946 | A | | 8/1988 | Dagard et al. | 376/282 |
| 4,903,491 | A | * | 2/1990 | Larinoff | 165/111 |
| 4,905,474 | A | * | 3/1990 | Larinoff | 165/111 |
| 4,926,931 | A | * | 5/1990 | Larinoff | 165/113 |
| 5,005,351 | A | * | 4/1991 | Archer | 60/686 |
| 5,113,933 | A | * | 5/1992 | Larinoff | 165/111 |
| 5,313,830 | A | * | 5/1994 | Goode | |
| 5,385,202 | A | | 1/1995 | Drosdziok et al. | 165/1 |
| 5,632,329 | A | | 5/1997 | Fay | 165/113 |
| 5,787,970 | A | * | 8/1998 | Larinoff | 165/111 |
| 6,289,976 | B1 | * | 9/2001 | Larinoff | 165/113 |

* cited by examiner

AIR EJECTOR VACUUM CONTROL VALVE

BACKGROUND

1. Field of the Invention

This invention relates to a method for preventing freezing in the condensing tubes of a power plant's air-cooled condenser. Employing the present invention, freezing is prevented by regulating the difference in pressure between the exhaust steam header of the condenser and the air ejector system thereby properly regulating temperature in the condenser. More specifically the present invention relates to an air ejector vacuum control valve which prevents condensing tubes from freezing by regulating condensate flow when ambient temperatures are about or below freezing.

2. Background Art

Some power plants create electricity by burning fuel to create intense heat. The heat is used to vaporize liquid water in pipes near the heat source into steam. The steam inside the pipes, which is under great pressure, is directed to pass over the blades of a turbine generator. The steam forces the turbine generator to spin and creates electricity. See FIG. 1. After the steam is exhausted from the turbine, the steam enters a condensing system. Steam exhausted out of the turbine(s) enters a main steam header. The steam header directs the exhausted steam to condensing tubes where within a series of condensing tubes the steam is cooled and allowed to condense back into liquid water. The water is then piped back to the power plant's heat source where it is vaporized again and the cycle repeats itself. If the steam is not condensed and the turbine continues to exhaust steam, a back pressure on the exhaust side of the turbine builds. While some back pressure is expected, excessive back pressure reduces work output of the turbine, decreasing the efficiency of the turbine. Back pressure is reduced by condensing the steam after it exhausts from the turbine thereby reducing the back pressure in the system and allowing the generator to run more efficiently.

Several different methods for cooling the steam in condensing tubes to reduce the back pressure are known in the art. One method uses cool water running along the outside of the condensing tubes to cool the steam in the tubes. Another method uses air to cool the condensing tubes. Air-cooled condensers rely on wind blowing over and air being forced over the condensing tubes to cool the tubes and thereby speed up the condensation process. While natural winds and ambient temperatures may help to cool the condensing tubes, large industrial fans near the condensing tubes are also typically used to create the additional air flow necessary to cool the condensing tubes. See FIG. 2.

Several methods for preventing freezing in the condensing tubes have been attempted but the known methods are ineffective or impractical. One method suggests increasing the fan speed in order to condense all or most of the steam in the condensing tubes and prevent steam from entering the air ejector system through condensing tubes. This method is ineffective, however, because as the amount of steam and non-condensible gases entering the air ejector system is reduced, a pressure differential develops between the air ejector system and the exhaust steam header. As the fan speed increases and more of the steam in the condensing tube is condensed, the vacuum in the air ejector system gets stronger. Eventually, the vacuum created by the pressure differential is great enough that the steam uptake limit (the amount of steam that normally can enter the condensing tubes) is overcome and large amounts of steam, water vapor and condensate are quickly sucked up through the condensing tubes into the air ejector system. When the air ejector vacuum overcomes the steam uptake limit of a tube, the condensing tube becomes a "super conductor" of steam, carrying steam and condensate into the air ejector system. Once in the air ejector system (AES), the steam, water vapor and condensate come into contact with severely sub-cooled portions of the condensing tubes where the condensates freeze.

Another known method for preventing freezing attempts to use the vacuum created in the air ejector system to draw warm steam from the lower portion of the condensing tubes up into the upper portion of the condensing tubes. It is intended that the steam warm the upper portion of the condensing tube and maintain the upper section at temperatures above freezing. This method runs the risk of creating "super conducting" tubes as explained above and is generally ineffective in keeping the condensing tubes warm enough to prevent freezing.

A third method suggests that by rotating the angle of the angle of the blades of the fans to slow down the air flow across the tubes, the velocity of the steam entering the tubes will decrease and the amount of condensate entering the AES will be eliminated or reduced. Rotating the angle of the fan blades is an inefficient method for controlling air flow.

Another method involves isolating different sections of the condensing tubes in an air ejector system and creating strong vacuums in the isolated sections for a limited period of time in order to pull the warm steam up into the sub-cooled areas. During this time, the isolated sections do not function as steam condensers. This method is time consuming and ineffective.

What is needed is a system, apparatus and method which prevents the damage malfunction, and freezing caused by the conducting of excessive amounts of steam over sub-cooled portions of the condensing tubes, while allowing for efficient operation of the electrical generator equipment and condensing system. What is also needed is a system, apparatus and method which prevents the damage and malfunction caused by freezing condensate in the AES when ambient temperatures are below freezing, while allowing for efficient operation of the electrical generator equipment and condensing system.

OBJECTS AND BRIEF SUMMARY OF THE INVENTION

It is an object of the present invention to prevent damage to a condenser and the condenser tubes as a result of condensate freezing in the condensing tubes. Damage from freezing is the result of an inability to appropriately regulate the flow of steam, condensate and gases in the condensing tubes.

It is also an object of this invention to provide a method of deterring freezing in aircooled condenser that maintains a predetermined pressure differential between the pressure in the air ejector system and the pressure in the exhaust steam header.

It is another object of the present invention to provide a method of deterring freezing in the condensing tubes of a condenser that allows the condenser to run as efficiently as possible when ambient temperatures are below freezing.

It is a further object of this invention to provide a method of deterring freezing in an air-cooled condenser that does not require sections of the air-cooled condenser to be shut down or isolated for warming and that allows all sections of the air-cooled condenser to continue operating in subfreezing ambient temperatures.

It is an object of this invention to provide a method of deterring freezing in an aircooled condenser that does not require a change in the configuration of the fan blades in order to prevent the condensing tubes from conducting condensate into the air ejector system.

It is an additional object of this invention to provide a method of deterring freezing in an air-cooled condenser that effectively balances the need for a pressure differential between the air ejector system and the exhaust steam header to draw steam up through the condensing tube and the need to maintain the back pressure in the air ejector system at a level only slightly below that of the back pressure of the exhaust steam header.

It is another object of this invention to provide a method of deterring freezing within the condensing tubes of an air-cooled condenser that is effective and relatively inexpensive to install, operate, and maintain.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects and in accordance with the invention as embodied and broadly described herein a device and method are provided for deterring freezing within the condensing tubes of a condenser. The present invention comprises a means for measuring the pressure differential between the exhaust steam header and the air ejector system and means for regulating the pressure differential. The pressure differential can be measured directly or calculated. Regulating the pressure differential can be accomplished by one of several methods. A mechanical control valve can be disposed within the air ejector system (AES) which effectively isolates the air ejector pump from the AES header thereby selectively controlling the effect the pump has on pressure within the AES. In an alternative embodiment, an exhaust valve can be disposed within the AES header to selectively control the pressure in the AES header. This can increase or decrease the work load on the air ejector pump, effectively reducing pressure in the AES. In still another embodiment, the pump itself can also be used to regulate pressure in the AES. So long as the pressure differential is maintained at a desired level steam, water vapor, and condensate are prevented from being drawn into the AES.

The invention further comprises means for monitoring and maintaining the tube exterior air temperature of the D-section condensing tubes at near ambient air temperature. When tube exterior air temperatures exceed ambient air temperatures, the warmer temperatures indicate that steam is probably being drawn toward the top of the condensing tube and potentially into the AES. The system is then modulated to further cool the condensing tube and condense the steam before the steam enters the AES. The means for monitoring and maintaining the tube exterior air temperature in the condensing tubes facilitates freeze protection by helping to prevent steam from flowing from the condensing tubes into the air ejector system and by helping to maintain an appropriate pressure differential between the exhaust steam header and the AES.

The present invention allows the temperature in the condensing tubes to remain sufficiently cooled, condensing essentially all of the steam in the condensing tubes. This allows the air-cooled condenser to run as efficiently as possible when ambient temperatures are below freezing without risking damage from freezing.

BRIEF DESCRIPTION OF THE DRAWINGS

In order to completely understand the manner in which the above-recited and other advantages and objects of the invention are obtained, a more particular description of the invention briefly described above will be rendered by reference to specific embodiments thereof which are illustrated in the appended drawings. The disclosure of the drawings is expressly incorporated herein. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 3:
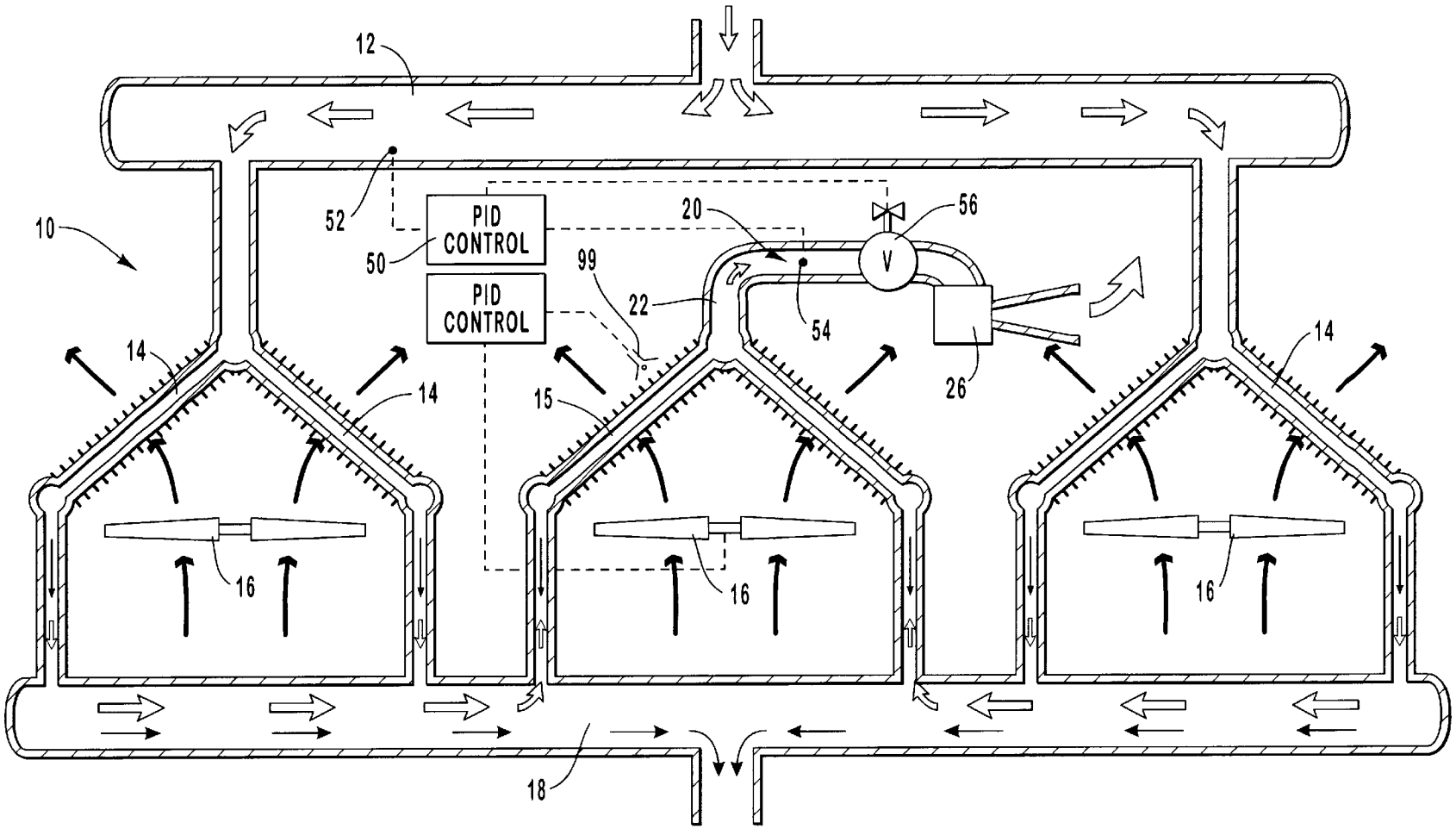
FIG. 3 is a diagram of a side view of the K section and D-section of an air-cooled condenser.

As shown in FIG. 3 the main components of the air-cooled condenser 10 include an exhaust steam header 12, steam condensing tubes 14, large fans 16, second steam header 18 and an air ejector system 20. FIG. 3. The exhaust steam header 12 is a conduit that carries the steam from the generator steam turbine exhaust to the condensing tubes 14. Steam passing through the exhaust steam header 12 is drawn into the condensing tubes 14. Typically the condensing tubes 14 are positioned standing at an incline. The condensing tubes 14 lead to the second steam header 18 and then to a second set of condensing tubes 15 which are connected to the air ejector system 20. The air ejector system 20 (AES) further comprises an AES header 22 and an air ejector pump 26. The pump 26 creates a pressure differential between the AES 20 and the exhaust steam header 12. The steam and gases naturally move from areas of higher pressure, namely, the exhaust steam header 12, through the condensing tubes 14, second steam header 18, condensing tubes 15, and into areas of lower pressure, namely, the air ejector system 20.

As shown in FIG. 3, there are two different configurations of condensing tubes 14 and 15 in which the steam is cooled until it condenses again into liquid water. In one configuration, the exhaust steam header 12 runs along the top of the downwardly extending condensing tubes 14, introducing steam to the top of the condensing tubes 14. In this configuration, referred to as a K-section, the exhaust steam header 12 is connected to the top of the condensing tubes 14 so that steam enters a condensing tube 14 from the top and moves down the condensing tube. Large fans having variable speed motors which allow the speed of the fan to be adjusted cool the condensing tubes. Variable speed fans 16 allow the operator to adjust the fan speed precisely for the most efficient use of the fan. As the steam is moving down the condensing tube 14, the steam is cooled and condensed, forming liquid water. The water condensate flows downward by gravity. In this type of configuration the condensed water and steam both run concurrently down the condensing tube 14, flowing in the same direction toward and into second steam header 18 and the second configuration of tubes.

In the second configuration of tubes known as the D-section, the second steam header 18 runs along the base of upwardly extending condensing tubes 15, introducing steam at the bottom of the condensing tubes 15. In this configuration, uncondensed steam is drawn up into the condensing tubes 15. As the fans 16 cool the condensing tubes 15, the steam cools and condenses as it rises up through the length of each condensing tube 15 in the D-section. As the rising steam is cooled in the condensing tubes 15, the steam condenses into liquid water and begins to run down the condensing tubes 15 by gravity, against the flow of the upward rising steam and gases, back toward the second steam header 18. The gas and condensate flow countercurrent to each other in the D-section.

Figure 4:
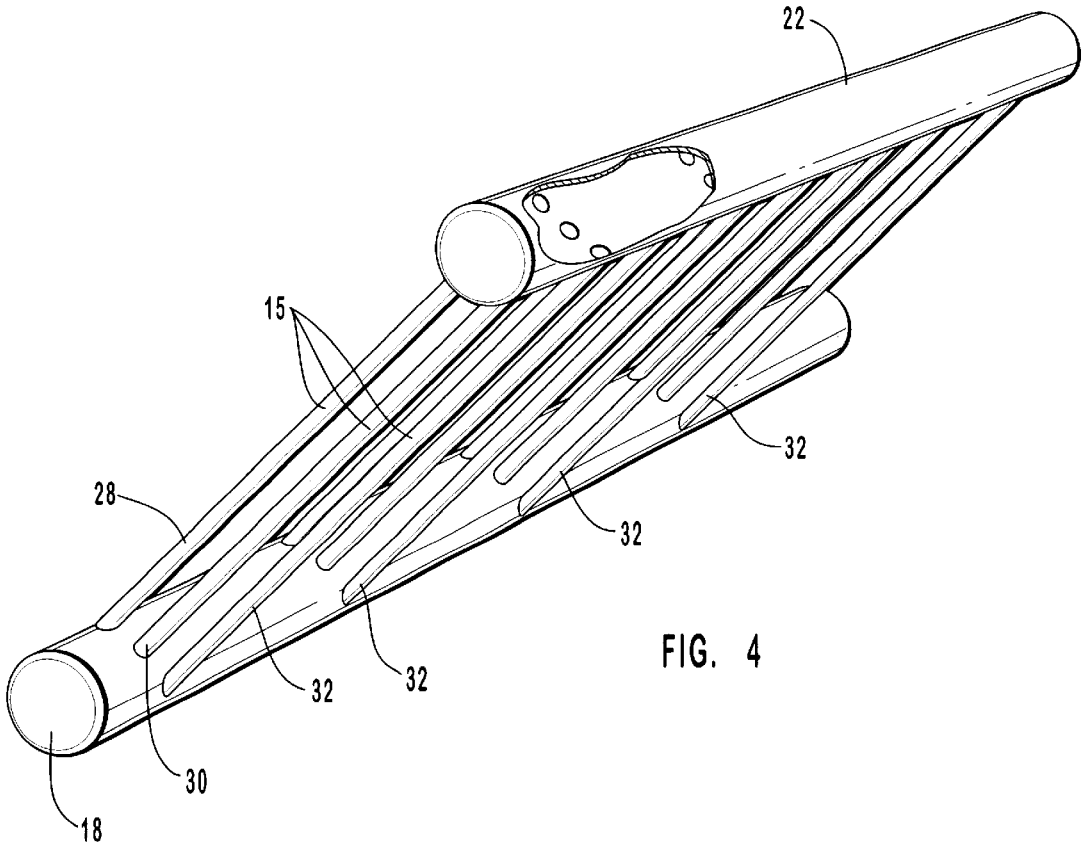
FIG. 4 is a diagram of the D-section condensing tubes with a portion of the AES header cut away.

In one type of D-section configuration, the condensing tubes 15 are grouped into bundles of three tubes, the three tubes 28, 30, 32 rising at a similar incline or an angle from the second steam header 18. FIG. 4. The three tubes 28, 30, 32 in each bundle are "stacked" so that one tube is above the other tube. The tube on the top is referred to as the upper tube 28 of the bundle, the tube on bottom is the lower tube 32, and the tube between the upper tube 28 and the lower tube 32 is the intermediate tube 30. Typically, several bundles of condensing tubes 15 are arranged side by side, in rows. When the tubes 15 are viewed together in long rows, the upper tubes 28 of the bundles create a long row or sheet of tubes called the upper tube sheet, the intermediate tubes 30 form an intermediate tube sheet and the lower tubes 32 make up the lower tube sheet.

Figure 1:
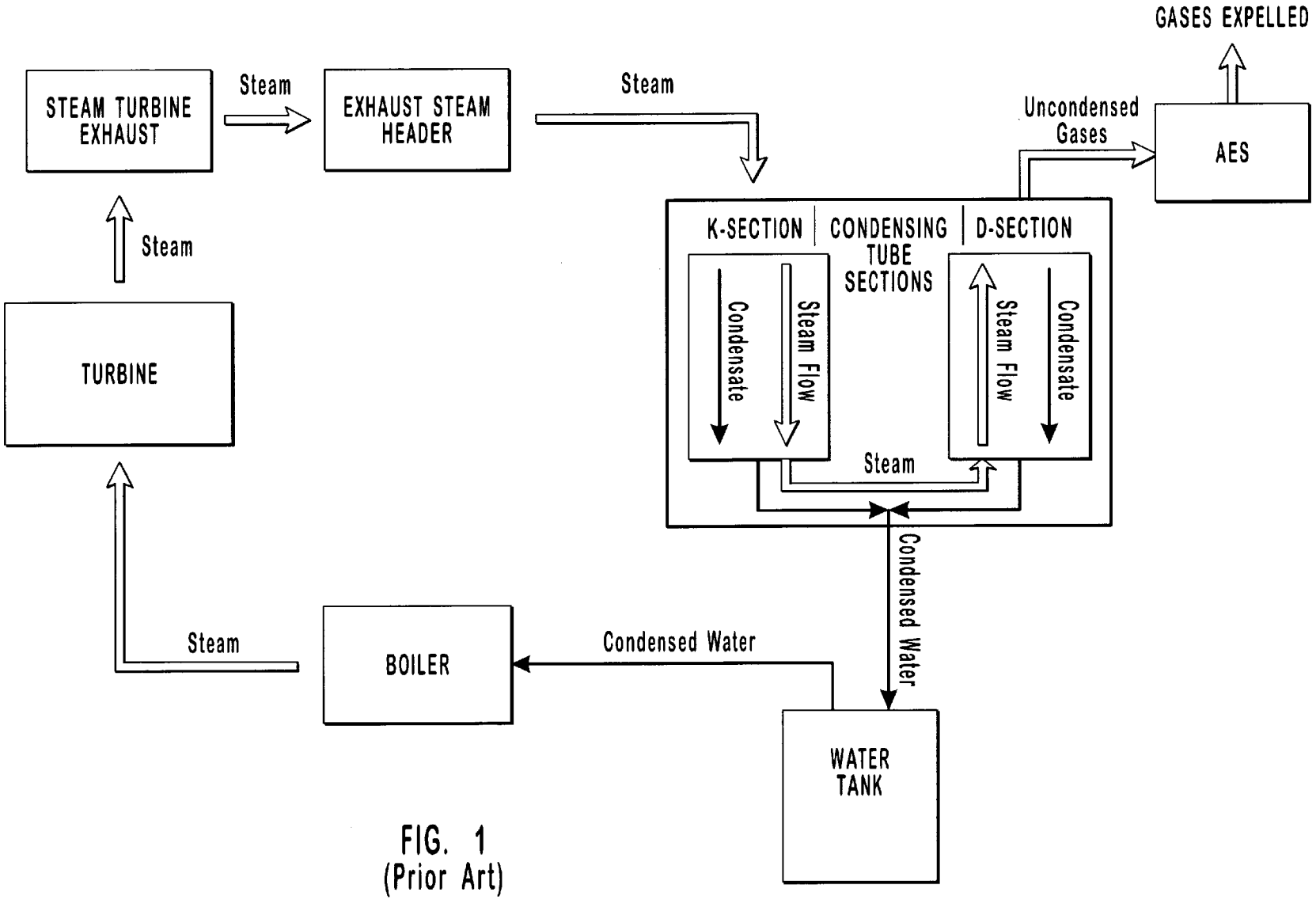
FIG. 1 (Prior Art)
FIG. 1 is a diagram of a steam turbine power plant.
Figure 2:
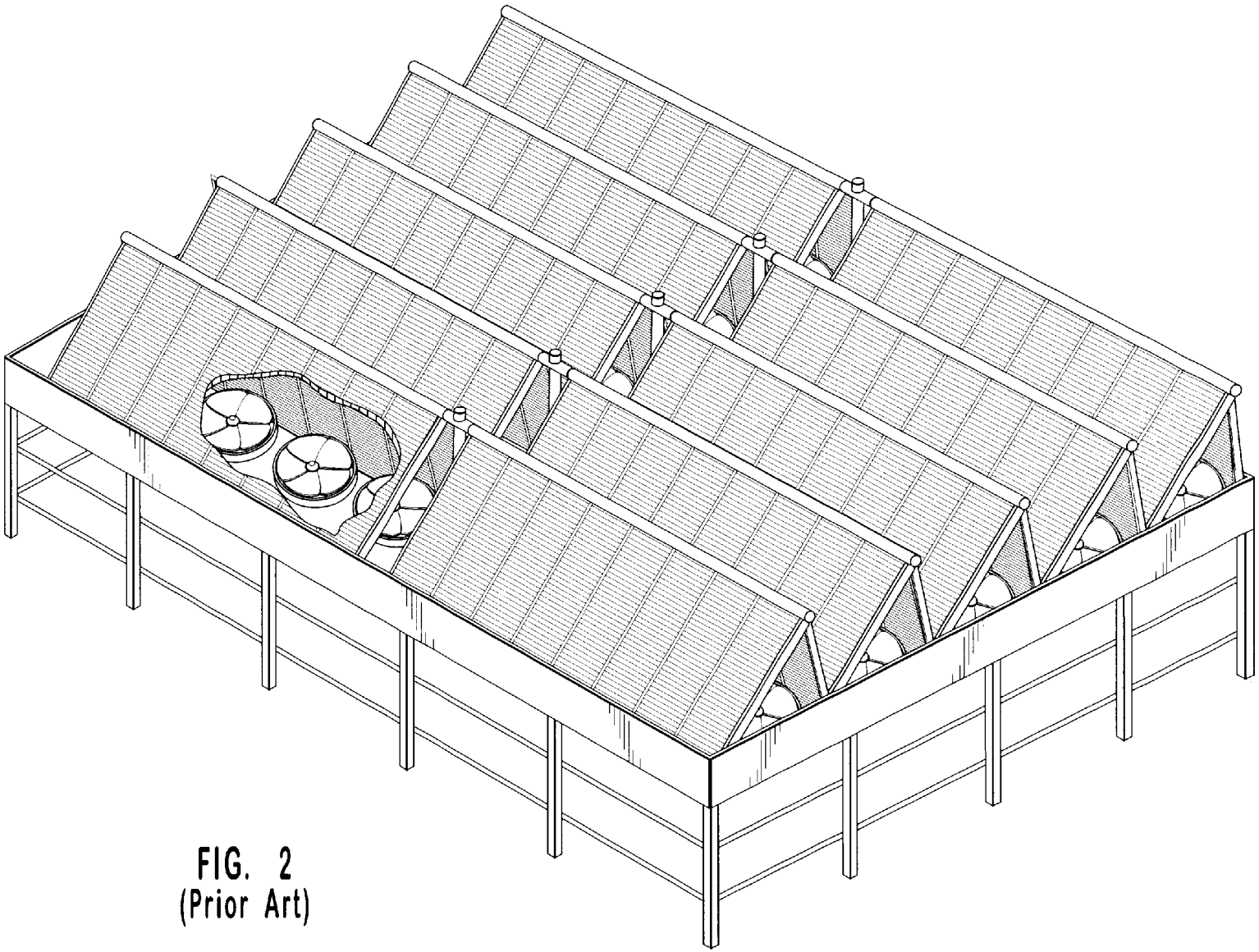
FIG. 2 (Prior Art)
FIG. 2 is a perspective view of an air-cooled condenser with a cut away view of the condenser fans.

A portion of the steam rising up the tube 15 will cool and condense upon entering the tube while the rest of the steam continues to rise up the condensing tube 15. FIG. 3. As the steam travels up the length of the condensing tube 15, more of the steam is cooled and condensed until all steam that is intended to be condensed, is condensed. Any steam condensed into liquid flows downward by gravity through the condensing tube 15, against the flow of the steam, and back into the second steam header 18. The liquid water drains out of the steam header 18 and is collected in the water pipes (not shown) which conduct the water to the power plant's water tank or heat source. FIG. 1.

The AES 20 has an air ejector system header 22 attached to the top of the D-section condensing tubes 15. FIG. 3. Uncondensed steam and inert gas are drawn into and collected in the AES header at the top of the condensing tubes 15. The steam and gases in the condensing tube 15 flow into the AES header 22 because a vacuum pump 26 in the AES (air ejector pump 26 or AES pump 26) run continuously thereby lowering the pressure in the AES 20 to a point below the pressure of the exhaust steam header 12. The pressure differential draws steam and gases into the condensing tubes 15 where steam is condensed and then draws uncondensed gases into the AES header 22 where the gases are then ejected from the D-section into ambient air.

The AES vacuum pump 26 runs continuously and at a constant rate, ejecting the steam and other uncondensed gases into the atmosphere. Sometimes a portion of the steam entering the D-section condensing tubes 15 is not condensed and is drawn from condensing tubes 15 into the air ejector system 20. If increased amounts of steam from the condensing tubes 15 enter the AES 20, this will result in increased pressure in the AES 20. Conversely, if substantially all the steam is condensed in the condensing tubes 15 and only the remaining uncondensed gases are drawn into the AES 20, then the pressure in the AES 20 decreases.

Temperature of the D-section condensing tubes 15 effects the condensation rates in the tubes 15. As the fan speed increases, the temperature of the condensing tubes 15 decreases, and more steam is condensed. When the temperature in the condensing tubes 15 is low enough, virtually all the steam is condensed. In the D-section, when essentially all the steam entering a condensing tube 15 is condensed, then no significant amounts of steam exit the condensing tubes 15 into the AES and the top of the condensing tube 15 contains virtually no steam. The portion of the condensing tube 15 where the last significant amounts of steam condense is called the zone of last condensing.

Condensing all of the steam in a condensing tube 15 reduces back pressure in the condenser 10 however, once the temperature in condensing tube 15 is low enough so that all the steam in a particular condensing tube 15 is condensed, increasing the fan speed to turfther lower the temperature of the condensing tube 15 introduces inefficiencies and will not reduce back pressure any further. This is because there is a limit to the rate at which steam can enter a D-section condensing tube 15. The rate at which steam can enter a D-section tube 15, (the rate of steam uptake) is limited by the flow of condensate exiting the condensing tube 15. Once the steam uptake limit is reached, increasing fan speed will only cause the zone of last condensing to drop to a lower elevation in the condensing tube 15. If the temperature in the condensing tube 15 is low enough so that all the steam in a condensing tube 15 is condensed, then increasing the fan speed will not further reduce back pressure and does not correspondingly increase the rate of steam uptake. Under these conditions, lowering the zone of last condensing wastes fan electricity. That is, complete condensation is achieved at both elevations of the zone of last condensing, and a lower zone of last condensing produces no added benefit and is therefore a waste of fan power.

In order to run the system more efficiently, automated controls vary the fan speed in an attempt to substantially utilize the full length of the D-section condensing tube 15 for condensation and avoid wastefully lowering the zone of last condensing and to regulate pressure in the AES 20. When the ambient temperature is above water-freezing temperature, the D-section fan speed can be regulated to minimize fan power requirements. Fan speed can be regulated by measuring and maintaining the temperature of the air which has passed over the exterior of the tubes and cooled the tube bundle. If the temperature of the air being blown by the fans across the exterior of a tube bundle is greater than a desired temperature or in other words, if the temperature of the air passing across the exterior of the condenser tube 15, measured by temperature sensor 99, is greater than a desired value or given set point, the fan 16 associated with that section speeds up, lowering the tube exterior air temperature. If the tube exterior air temperature is lower than the desired air temperature set point, suggesting that condensing tube 15 is being sub-cooled, the fan 16 slows down and the tube exterior air temperature increases. In short, using a tube exterior air temperature set point, the elevation of the zone of last condensation can be controlled using fan speed. The tube exterior air temperature set point used to minimize fan power requirements by controlling the elevation of the zone of last condensing can also be used to regulate the pressure in the AES 20. If the pressure in the air ejector system 20 is higher than a desired pressure, such as a selected back pressure set point, then the tube exterior air temperature set point is reduced. Lowering the exit air temperature set point results in an increase in fan speed which condenses more steam and reduces the pressure in the air ejector system 20. Though the range of regulation is limited using this technique, vent fan speed can be controlled much closer to optimum efficiency at varying ambient temperatures and back pressures.

Apart from efficiency concerns, the pressure in the AES 20 should be regulated to keep the condenser 10 running properly. In D-sections, steam condensation creates a vacuum which pulls steam into the condensing tubes 15. Because the AES vacuum pump 26 runs continuously, when all the steam is being condensed in the D-section condensing tubes 15 and little or no steam is entering the AES 20, the pressure differential between the AES and the exhaust steam header 12 can increase significantly. As the steam load on the AES vacuum pump 2decreases under these conditions, the pressure differential between the exhaust steam header 12 and the AES 20 increases, and the vacuum drawing the steam up the condensing tubes 15 is stronger. This strong vacuum can cause significant amounts of uncondensed steam, water vapor and condensate (liquid water) to be drawn into the AES 20. When ambient conditions are above the freezing temperature of the condensate, this does not pose a problem. However, as discussed below, if uncondensed steam, water, vapor, or condensates are drawn into the AES 20 when ambient temperatures are below the freezing temperature of the condensate, freezing within the condensing tubes 15 or AES 20 can occur causing obvious structural and functional problems.

Operation of the air-cooled condenser 10 is modified when outdoor temperatures are below the freezing temperature of the condensate. Freezing temperature refers to the temperature at which the condensate (water) freezes. When ambient temperatures fall below freezing, the condensate or water in the condensing tubes 14 and 15 can freeze and damage the system and interfere with the function of the condensing tubes 14 and 15. The term "freezing" herein does not refer to the formation of rime ice.

Freezing is a problem in both the K and D sections. Freeze protection in the K sections can be provided using steam traveling into the tubes. Thermocouples, or some other means, monitor temperatures in the K section for areas of sub-cooling. When subcooling is detected, fans 16 slow to reduce sub-cooling. Steam in the condensing tubes 14, warms the tubes 14 and prevents freezing. Freeze protection is provided for the D-section in a different manner.

Two factors lead to freezing in D-sections. The first factor is the extreme sub-cooling of certain portions of the D-section tube bundles. When fans 16 lower the temperature in a condensing tube 15 to the point that all of the steam entering the condensing tube 15 is condensed before it rises up the length of the condensing tube 15, there is practically no steam in the top of the condensing tube 15. The fans 16 and ambient environmental temperatures may combine to excessively cool the condensing tube 15 so that the top of the condensing tube 15, where there is no steam, becomes sub-cooled. In the lower tube sheets, the sub-cooling problem is compounded because the lower tubes 32 are closer to the fans 16 with the result that they are generally cooler than the intermediate tubes 30 and upper tubes 28. See FIG. 4. Since the tops of all D-section condensing tubes 15 are prone to subcooling and the lower tubes 32 are closer to fans 16, in sub-freezing weather the tops of the lower tubes 32 become extremely cold. Water that comes into contact with a sub-cooled condensing tube 15 can quickly freeze causing the damage and malfunction already mentioned.

The second factor leading to freezing in the D-section is condensate back flow in the AES 20. Condensate back flow occurs in the AES 20 because the tops of the upper tubes 28 and intermediate tubes 30 connect with the air ejector system header 22 at points higher than the point where the lower tubes 32 connect. When steam or condensate flows through the entire length of the upper tubes 28 and intermediate condensing tubes 32 and enters the air ejector system header 22, it is possible for the steam or condensate to back flow into the tops of the lower tubes 32. Also, because of the shape of the AES header 22, gravity will pull condensate and other liquid in the air ejector system 20 toward the tops of the lower tubes 32. If the tops of the lower tubes 32 are sub-cooled, water coming into contact with the sub-cooled tube can freeze.

As shown in FIG. 3, the present invention comprises means for measuring the pressure differential between the exhaust steam header 12 and the air ejector system 20. The means for measuring the pressure differential can be a standard instrument known in the art, suitable for determining differences in pressure. In a preferred embodiment of the present invention, means for measuring the pressure differential comprises a distributed control system 50 linked to one or more pressure transmitters. The distributed control system receives input from pressure transmitter 52 in the exhaust steam header near the turbine exhaust and from the pressure transmitter 54 in the air ejector system and is able to read or otherwise calculate the difference in pressure. FIG. 3.

Alternatively, the present invention provides means for measuring the value of the pressure of the exhaust steam header 12, separate means for measuring the value of the pressure of the AES 20, and means for comparing the pressure values measured at the exhaust steam header 12 and the AES 20. The means for comparing determines the difference in the two pressure readings by subtracting air ejector system pressure from the turbine back pressure. Both means for measuring the value of the pressure of exhaust steam header 12 and means for measuring the value of pressure of the AES 20 can be standard pressure gauges or transmitters known in the art. Gauges or transmitters are preferably placed at the turbine exhaust and in the air ejector system header 22 but alternative locations are contemplated. In this alternative embodiment of the present invention, a distributed control system 50 is linked to a pressure transmitter 54 in the air ejector system and linked to a pressure transmitter 52 measuring turbine back pressure near the turbine exhaust. The distributed control system 50 receives pressure measurements from the transmitters 52 and 54 and calculates the difference in pressure.

Figure 5:
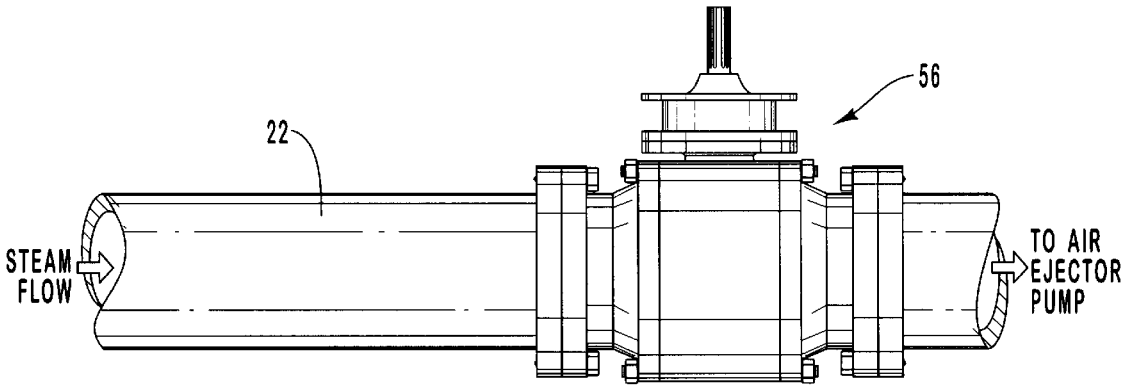
FIG. 5 is a perspective view of a valve disposed within the AES.

The present invention further comprises means for regulating the pressure differential between the AES 20 and the exhaust header 12. The means for regulating the pressure differential is provided to prevent a pressure differential from developing which is great enough to pull uncondensed steam or condensate from the condensing tubes 15 or the AES 20. Means for regulating the pressure differential alters pressure in the AES 20 based on the pressure differences monitored by means for measuring the pressure differential. In one embodiment of the present invention the means for regulating the pressure differential is a vacuum control valve 56. The vacuum control valve 56 can create a mechanical "resistence" to the air ejector system pump 26. In a preferred embodiment, the vacuum control valve 56 is disposed such that it is capable of completely isolating the vacuum pump 26 from the AES header 22 if desired. See FIG. 5. The vacuum control valve 56 is disposed within the AES 20 between the vacuum pump 26 and opening of the condensing tubes 15 into the AES 20 such that pressure in the AES 20 can be regulated on the upstream side of the control valve 56. In this way, undesirable pressure differentials can be avoided. A standard V-ball valve, such as the Fischer® V-ball valve shown in FIG. 6, is used in the preferred embodiment of the present invention.

Figure 6:
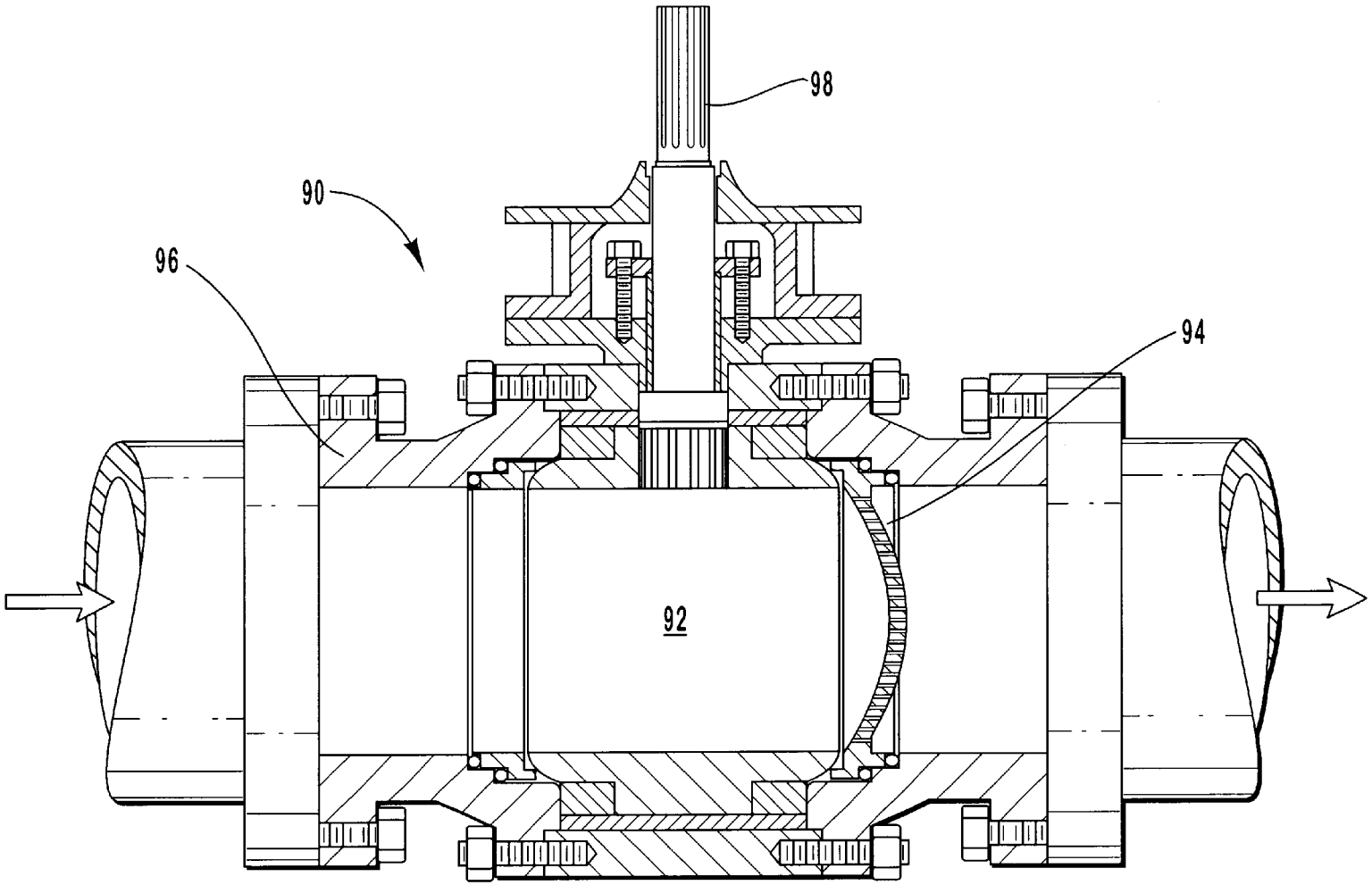
FIG. 6 is a cross section of one embodiment of an air ejector control valve.

The V-ball valve of FIG. 6 shows ball valve 90 having ball 92, attenuator 94, ball seal 96, and splined shaft 98.

When the vacuum control valve 56 disposed within the AES 20 is completely closed it effectively isolates the AES 20 from the rest of the condenser 10. The ejector pump 26 continues to run, but when the control valve 56 is completely closed and the ejector pump 26 is isolated, the pump 26 no longer creates a pressure differential and therefore no longer draws steam and other gases into the air ejector system 20. Isolating the air ejector pump 26 effectively reduces or eliminates the difference in pressure otherwise created by the air ejector pump 26. In order to more precisely regulate the back pressure, the control valve 56 is capable of throttling, opening and closing, thereby permitting the selective control of a desired pressure differential between the AES 20 and the exhaust steam header 12. By partially opening and closing the control valve, a specific pressure differential is more readily maintained. In other words, the strength of the vacuum created in the AES 20 is selectively controlled by modulating the vacuum control valve 56 to establish or maintain a desired pressure differential which will prevent steam, water vapor and/or condensate from being drawn into the AES header 22. Accordingly, the control valve 56 prevents the flow of water in the AES 20.

In one embodiment of the condenser 10, the AES steam header 22 which collects steam and gases exiting the condensing tubes comprises intermediate AES headers (not shown) which all connect to a larger, common AES steam header 22. During condenser operation, steam and other gases flow from the top of the D section condensing tubes 15 into the intermediate AES headers, and then into the common AES steam header 22. In this embodiment, the air ejector pump is located in the common AES header 22 near a terminal end. The vacuum control valve 56 is disposed within the common AES header 22 between the ejector pump 26 and intersection or connecting points of the intermediate AES headers to the common AES header 22. So positioned, the control valve 56 can isolate the ejector pump 26 from the rest of the air ejector system. In the preferred embodiment of the present invention, a four-inch control valve is disposed in a common AES header 22 with a six-inch diameter. Bell reducers are attached on either side of the four-inch control valve, to adapt the valve to the diameter of the common header 22.

When ambient temperatures are above freezing and the control valve 56 is not in operation, the control valve 56 is typically 100% open. When temperatures drop to a selected temperature just above freezing, the freeze protection mode is engaged or turns on and the control valve 56 throttles open and closed. The freeze protection mode will remain engaged until the temperature rises to a few degrees above the selected temperature, the temperature at which the protection mode was initially engaged. Turning the freeze protection on and off in this manner creates a high/low setting that engages the freeze protection mode when the temperature drops to a selected low and disengages the freeze protection when the temperature rises above a selected high temperature set point. The disengaging or "off" temperature should be a few degrees higher than the engaging or "on" temperature. The gap between the high temperature and low temperature prevents the freeze protection from being sporadically engaged and then disengaged with slight fluctuations in temperature. In other words, without this high/low setting, if the freeze protection turned on when temperatures were below 32 degrees Fahrenheit and turned off when temperatures were above 32 degrees, then the freezing protection mode would turn on and off sporadically if the ambient temperature fluctuated back and forth between 32.1 and 31.9 degrees. The high/low setting efficiently engages and disengages the freeze protection mode.

An alternative embodiment of the present invention employs an in flow valve which opens to ambient pressure or exhaust steam header 12 as the means for regulating the pressure differential. In one embodiment of the present invention, the distributed control system 50 electronically opens the in flow valve when the ambient temperatures are about or below freezing and when the pressure difference between the AES 20 and the exhaust steam header 12 is nearly great enough to pull condensate out of the condensing tubes 15 and into the AES 20. Opening the in flow valve allows ambient atmosphere or steam into the AES 20. The pressure in the AES 20 increases as air or steam enters the AES 20 from outside the system. The in flow valve throttles to regulate the pressure in the AES 20 by regulating how much atmospheric air is let into the AES 20. The AES ejector pump 26 continues to eject the gases to the outside environment, and working in concert with the exhaust valve, keeps the pressure in the AES 20 slightly lower than the pressure in the condensing tubes 15 and exhaust steam header 12. This alternative embodiment of the present invention may have the advantages of lower costs and less hardware.

Header 12 is at a vacuum to atmosphere. For example, condenser 10 may be approximately six inches Hg absolute while the atmospheric pressure may be 30 inches Hg. If steam supply from the exhaust header is utilized for regulation, the portion of the AES in contact with the steam admission must be maintained above freezing.

It is also contemplated that the means for regulating the pressure differential may be integral with the air ejector pump 26 such that it controls the suction generated by the ejector pump 26. For example, if the air ejector pump 26 is not run at a continuous load and can be adjusted, the ejector pump 26 could be used to regulate the pressure in the AES 20 to maintain it at the desired pressure relative to the back pressure in the exhaust steam header 12.

The present invention also provides means for monitoring and maintaining the exit tube exterior air temperature of the condensing tubes 15 at ambient temperature, when ambient temperature is about or below freezing to minimize fan power requirements and facilitate freeze protection. In one embodiment of the present invention, a thermocouple or similar temperature sensor 99 may be disposed on the outside of condensing tube 15 in the air flowing over the exterior of tube 15, near the junction with the AES headers 22 as shown in FIG. 3. Sensor 99 is positioned about three-fourths of the way up the tube 15. If the temperature of the air passing over condensing tube 15 is greater than the ambient air temperature, this indicates that steam is probably reaching the end of the condensing tube 15 and possibly passing into the air ejector system 20. Therefore, when the tube exterior temperature reading as measured by temperature sensor 99 is above ambient temperature, the fan speed is increased thereby lowering the temperature of the condensing tubes 15 to near ambient temperature (for example ambient temperature +5° F.), lowering the zone of last condensing in the condensing tubes 15, and preventing steam from entering the air ejector system 20. When the tube exterior air temperature is near ambient temperature (such as ambient temperature +5° F.), the fan speed can be reduced to prevent wasting power on unnecessary fan speed. Additionally, the tube exterior air temperature can be regulated using the previously discussed vacuum control valve 56 to reduce the pressure differential and regulate steam flow.

In a preferred embodiment, means for measuring the pressure differential and means for regulating the pressure differential comprise a computerized controller linked to input and output devices. The input devices may include one or more pressure transmitters. The computerized controller may be a part of a larger distributed, digital control system. The distributed control system may be any suitable control system commercially available capable of accomplishing the functions to be herein described. Furthermore, the individual components of the control system may be hardware components readily available. Briefly, in one presently preferred embodiment, the present invention is accomplished through use of the Bailey Network 90® controller available from Bailey Controls. Of course, it will be appreciated by those skilled in the art that a variety of computerized systems may be used to accomplish the functions to be described herein.

Figure 7:
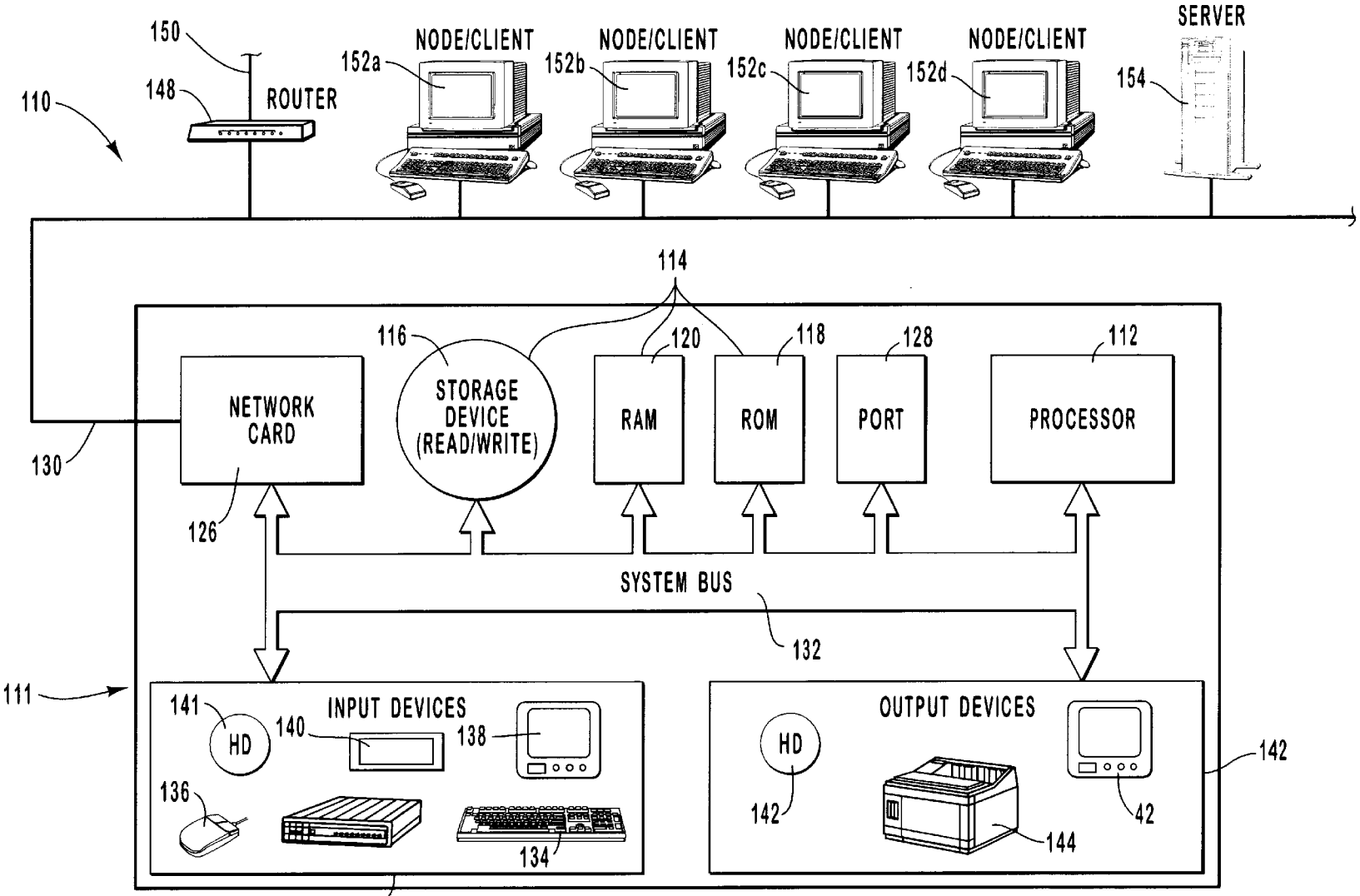
FIG. 7 is a block diagram of a control system.

FIG. 7 illustrates an apparatus that may be used in accordance with the present invention to prevent freezing in an air-cooled condenser. Generally, the apparatus as shown in FIG. 7 functions as a computer with inputs being fed into it thereby allowing the computer to prevent freezing by controlling the valve and other necessary hardware. The computer may be connected to a computer network to enable interactions with other computers, hardware, and software to accomplish other necessary tasks. In addition, the present invention may be accomplished by cooperating computers, software, and/or hardware which are interconnected through communication means. The communication means may be accomplished through a computer network, by wireless transmission, or the like.

Referring to FIG. 7, an apparatus 110 may implement the invention on one or more computers 111 containing a processor 112 or CPU 112. All components may exist in a single computer 111 or may exist in multiple computers 111, 152 remote from one another. The CPU 112 may be operably connected to a memory device 114. A memory device 114 may include one or more devices such as a hard drive or nonvolatile storage device 116, a read-only memory 118 (ROM) and a random access (and usually volatile) memory 120 (RAM).

The apparatus 110 may include an input device 122 for receiving inputs from a user or another device, such as a pressure sensor, a temperature sensor, a switch, etc. Similarly, an output device 124 may be provided within the computer 111, or accessible within the apparatus 110. A network card 126 (interface card) or port 128 may be provided for connecting to outside devices, such as the network 130 or remote computers.

Internally, a bus 132 may operably interconnect the processor 112, memory devices 114, input devices 122, output devices 124, network card 126 and port 128. The bus 132 may be thought of as a data carrier. As such, the bus 132 may be embodied in numerous configurations. Wire, fiber optic line, wireless electromagnetic communications by visible light, infrared, and radio frequencies may likewise be implemented as appropriate for the bus 132 and the network 130 or remote computers.

Input devices 122 may include one or more physical embodiments. For example, a keyboard 134 may be used for interaction with the user, as may a mouse 136 or stylus pad (not shown). A touch screen 138, a telephone 139, or simply a telephone line 139, may be used for communication with other devices, users, or the like. Similarly, a scanner 140 may be used to receive graphical inputs which may or may not be translated to other character formats. A memory device 141 of any type (e.g., hard drive, floppy, etc.) may be used as an input device, whether resident within the node 111 or some other node 152 on the network 130, or from another network 150. One or more switches may be fed into the computer 111 as input devices 122.

Output devices 124 may likewise include one or more physical hardware units. For example, in general, the port 128 may be used to accept inputs and send outputs from the node 111. A monitor 142 may provide outputs to a user for feedback during a process, or for assisting two-way communication between the processor 112 and a user. A printer 144 or a hard drive 146 may be used for outputting information as output devices 124. Another output device 124, such as a control valve, an exhaust valve, or ejector pump may be an input device connected to and controlled by the computer 111. In addition, a fan speed control may also be connected to the computer 111.

In general, a network 130 to which a computer 111 (or node 111) connects may, in turn, be connected through a router 148 to another network 150. In general, two nodes 111, 152 may be on a network 130, adjoining networks 130,150, or may be separated by multiple routers 148 and multiple networks 150 as individual nodes 111, 152 on an internetwork. The individual nodes 152 (e.g., 111, 152, 154) may have various communication capabilities.

In certain embodiments, a minimum of logical capability may be available in any node 152. Note that any of the individual nodes 111, 152, 154 may be referred to, all together, as a node 111 or a node 152. Each may contain a processor 112 with more or less of the other components 114–144.

A network 130 may include one or more servers 154. Servers may be used to manage, store, communicate, transfer, access, update, and the like, any practical number of files, databases, or the like, for other nodes 152 on a network 130. Typically, a server 154 may be accessed by all nodes 111, 152 on a network 130. Nevertheless, other special functions, including communications, applications, directory services, and the like may be implemented by an individual server 154 or multiple servers 154. A node 111 may be a server 154.

In general, a node 111 may need to communicate over a network 130 with a server 154, a router 148, or nodes 152 or server 154. Similarly, a node 111 may need to communicate over another network (150) in an internetwork connection with some remote node 152. Likewise, individual components 112–146 may need to communicate data with one another. A communication link may exist, in general, between any pair of devices.

Those of ordinary skill in the art will, of course, appreciate that various modifications to the diagram of FIG. 7 may easily be made without departing from the essential characteristics of the invention, as described in herein. Thus, the following description of the functionality required by the apparatus used by the present invention is intended only by way of example, and simply illustrates certain presently preferred embodiments consistent with the invention as claimed herein.

As stated, in one presently preferred embodiment, the computer 111 may be a commercially available controller. In current design, the controller 111 is a Bailey Network 90®. The controller 111 may be connected to various input and output devices directly, through a port 128, over a network 130, or by other suitable means. In an alterative design, a Bailey Infi 90 may be used. The presently preferred controller is roughly the equivalent of a stand-alone computer without the added complexity. The current controller is capable of handling many inputs and outputs, and comes with a variety of useful, built-in features. Presently, functions available with the Bailey Network 90® were used in implementing the present invention. For example, a PID function, PID controller block, was used in accomplishing the present invention. Of course, it will be appreciated by those skilled in the art that a different means for accomplishing the present invention could be used. For example, an IBM-compatible computer could have the necessary input and output interfaces installed to accomplish the present invention. In addition, the software required to accomplish the present invention could be written without the use of standard library functions available on the Network 90, and without the use of library functions available by many compilers used by those skilled in the art.

Figure 8:
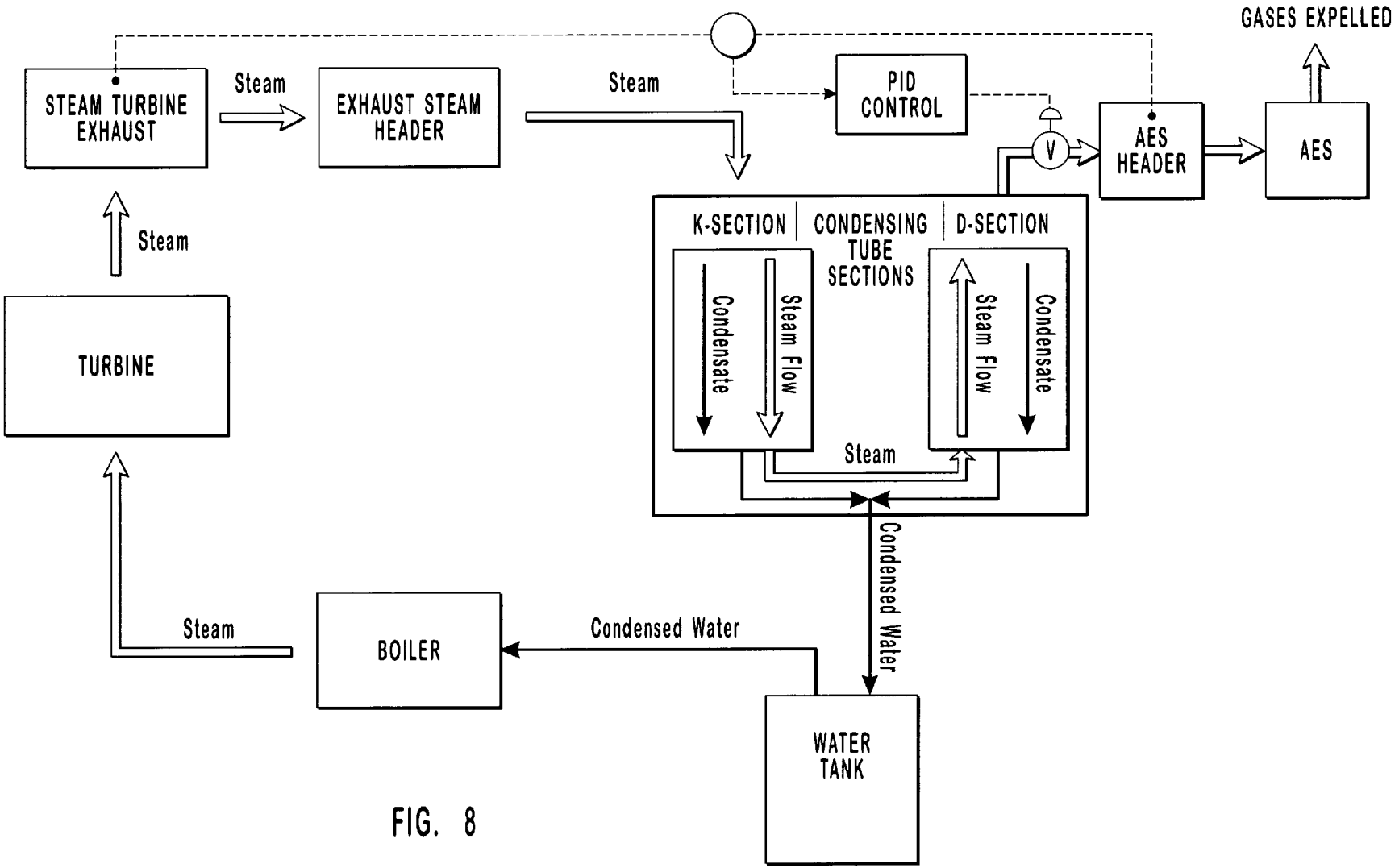
FIG. 8 is a diagram of a steam turbine power plant employing an air ejector control valve.

In a preferred embodiment of the present invention the means for measuring the differences in pressure is a dedicated differential pressure transmitter which measures the pressure in the exhaust steam header and the air ejector system and transmits a differential pressure (digital process (dp)) signal to a PID controller, as shown in FIG. 8. The PID controller communicates with the vacuum control valve 56 and will regulate the control valve 56 as necessary in order to maintain the desired pressure differential at a preferred pressure of about 0.60 inches of mercury (Hg). See FIG. 3. For example, if the turbine exhaust is 5.0 inches absolute mercury and the pressure in the air ejector system is at 2.0 inches of mercury, the control valve 56 would then throttle in a more closed position to isolate the air ejector pump 26 from the air ejector header 22 allowing the pressure in the air ejector system 20 to rise. As the pressure in the air ejector system 20 approaches 4.4 inches of mercury, the control valve 56 will begin to throttle to maintain that pressure. Because the control valve 56 effectively insulates the air ejector pump 26, pressure on the ejector pump side of the control valve 56 could be down to about 1.0 inch of mercury.

In the preferred embodiment of the present invention, the sample rate for the pressure differential transmitter may be several times a second but a different sample rate may be selected. When there is a given amount of error from the established back pressure differential set point, the PID controller 50 can change the control valve position by a certain percentage. Over time, if the back pressure continues not to reach the differential set point of 0.6 inches Hg, the PID controller 50 will continue to send an error signal and thus increase the control valve position to correspondingly adjust back pressure.

In the preferred embodiment of the present invention, the freeze protection mode for the air-cooled condenser is initiated as ambient air temperature cools and descends to below 33 degrees Fahrenheit. Should ambient air temperatures begin to increase, the freeze protection mode does not disengage until the ambient air temperature is above 35 degrees. Configuring the initiation of the freeze protection mode in this way allows the system to turn on and off based on the ambient temperature while preventing slight fluctuations in the temperature from engaging and disengaging the freeze protection. The sample rate for air temperatures is several times per second, but a different sample rate may be selected.

To increase the efficiency of the signal transmission within the signal processing system of the power plant, the present invention provides multiple sights and multiple processors throughout the signal processing system. The multiple sights and processors transmit the various signals to each other through a plant signal loop. Within a given processor, information can be readily shared without overloading the communications. The information transfer within a given processor might occur many times a second. However, when the information is transmitted from the local processor to other processors via the plant loop, the local processor will not transmit the information to the other processors along the loop if there has not been a change in the information to be transferred. The other processors will continue to operate based on the previously transmitted, unchanged value. This minimizes the signal traffic on the loop.

Damage can result to the air ejector system 20 if the control valve 56 malfunctions and remains closed 100% for a period of time. A preferred embodiment of the present invention includes an optional alarm to notify the operator of the air-cooled condenser if the control valve 56 has remained closed for too long of a period of time. The system is also provided with a manual/autostation that allows an operator to assume control over the automatic controls of the present invention, if desired. For example, the operator can change the pressure differential set point from 0.60 inches Hg to another pressure and can set the vacuum control valve 56 open a given percentage. If it is suspected that a condensing tube 15 has become blocked by a frost build up, the condensing fans 16 of the section can be operated in reverse to draw warm air from above the condenser across the condensing tube 15 and thereby melt the build up.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A method for preventing freezing in the counter current flow section of a power plant air cooled condenser comprising the steps of:

measuring the pressure within an exhaust steam header connected to tubes of the air cooled condenser and the pressure within an air ejector system header connected to the counter current flow section to obtain a pressure differential between the exhaust steam header and the air ejector system header;

regulating the pressure differential in the air ejector system header; and maintaining a controlled differential pressure between the air ejector system header and the exhaust steam header when ambient temperatures are near freezing to prevent freezing.

2. The method as described in claim 1 wherein the step of measuring the pressure further comprises the steps:

measuring the pressure within the exhaust steam header;

measuring the pressure within the air ejector system header; and calculating the pressure difference between the steam header and the air ejector system header.

3. The method of claim 1 wherein the step of regulating the pressure differential further comprises:

throttling a control valve disposed in the air ejector system header.

4. A device for preventing freezing, in a counter current flow section of a power plant air cooled condenser comprising:

means for measuring ambient temperature;

means for measuring a pressure differential between an exhaust steam header connected to tubes of the air cooled condenser and an air ejector system header connected to the counter current flow section;

means for regulating the pressure differential between the exhaust steam header and the air ejector system header; and means for maintaining a controlled differential pressure between the air ejector system header and the exhaust steam header when measured ambient temperatures are near freezing.

5. The device as described in claim 4 wherein the means for regulating the pressure differential prevents a pressure difference between the steam exhaust header and the air ejector system header from being great enough to carry condensate through a condensing tube into an air ejector system.

6. The device of claim 4 wherein the means for measuring the pressure differential comprises:

means for measuring the pressure in an exhaust steam header;

means for measuring the pressure in an air ejector system header; and means for calculating the pressure difference between the exhaust steam header and the air ejector system header.

7. The device claim 4 wherein:

means for measuring the pressure differential further comprises a PID controller, a first transmitter and a second transmitter, the first transmitter being disposed within the exhaust steam header, and the second transmitter being disposed in the air ejector system, the first transmitter and second transmitter communicating with the PID controller; and means for regulating the pressure differential further comprises the PID controller and a vacuum control valve disposed within the air ejector system header, the PID controller capable of opening and closing the vacuum control valve.

8. The device of claim 4 wherein means for regulating the pressure differential further comprises a PID controller and an exhaust valve, the exhaust valve being disposed within the air ejector system header and the PID controller being capable of opening and closing the exhaust valve.

9. The device of claim 4 wherein means for regulating the pressure differential further comprises a PID controller and an air ejector system vacuum pump disposed within the air ejector system, the vacuum pump capable of maintaining a controlled pressure within the air ejector system.

10. The device of claim 7 wherein the vacuum control valve is a V-ball valve disposed within the air ejector system header.

* * * * *